United States Patent [19]

Wilson

[11] 4,063,726

[45] Dec. 20, 1977

[54] ELECTRONICALLY CONTROLLED HYDRAULIC EXERCISING SYSTEM

[76] Inventor: Robert J. Wilson, 8401 E. Cambridge, Scottsdale, Ark. 85257

[21] Appl. No.: 680,499

[22] Filed: Apr. 26, 1976

[51] Int. Cl.[2] ..... A63B 21/00

[52] U.S. Cl. ..... 272/130; 272/DIG. 4

[58] Field of Search ..... 272/130, 116, 125, 129, 272/DIG. 6; 73/379 R; 128/25 R, 24 R

[56] References Cited

U.S. PATENT DOCUMENTS

| | | | |
|---|---|---|---|
| 2,068,578 | 1/1937 | Stronach | 272/130 |
| 3,369,403 | 2/1968 | Carlin et al. | 272/130 X |
| 3,451,271 | 6/1969 | Knobwauch | 272/130 X |
| 3,465,592 | 9/1969 | Perrine | 272/125 X |
| 3,784,194 | 1/1974 | Perrine | 272/130 X |
| 3,848,467 | 11/1974 | Flavell | 272/116 X |
| 3,902,480 | 9/1975 | Wilson | 272/130 X |

*Primary Examiner*—Harland S. Skogquist
*Assistant Examiner*—William R. Browne
*Attorney, Agent, or Firm*—Warren F. B. Lindsley

[57] ABSTRACT

An electronically controlled hydraulic exercising system employing a fluid actuated piston which is controlled by a device which automatically and selectively proportions in varying amounts the exercise resistance in each of two directions of movement of the piston. The device automatically controls the resistance by the use of electronic flip flop type logic network.

5 Claims, 10 Drawing Figures

| MODE | | VALVES A | B | C | D | E | F | REGULATOR | PUMP | |
|---|---|---|---|---|---|---|---|---|---|---|
| NORMAL | | O | C | O | C | C | O | REG. | ON | 1 |
| POSITIVE ONLY | LIFTING | O | C | O | C | C | O | REG. | OFF | 2 |
| | LOWERING | O | -- | -- | -- | O | O | -- | OFF | 3 |
| | | O | C | O | C | C | O | REG. | ON | 4 |
| NEGATIVE ONLY | LIFTING | O | O | -- | -- | O | O | -- | ON | 5 |
| | | O | C | C | O | O | C | REG. | ON | 6 |
| | LOWERING | O | C | O | C | C | O | REG. | ON | 7 |
| AUTO KINETIC | LIFTING | C | O | C | O | O | C | O | ON | 8 |
| | LOWERING | O | C | O | C | C | O | C | ON | 9 |
| SOLID | LIFTING | O | C | C | O | O | C | REG. | ON | 10 |
| | LOWERING | O | C | O | C | C | O | REG. | ON | 11 |

--NO EFFECT

ELECTRONICALLY CONTROLLED HYDRAULIC EXERCISING SYSTEM

BACKGROUND OF THE INVENTION

In recent years, the use of special exercises and associated equipment has become relatively highly developed and has been scientifically applied as physical therapy for the restoration of injured limbs as well as for routine use by athletes and others in building muscles or increasing physical strength and stamina.

Numerous papers and articles have been written advocating special types of exercises for specific purposes. Thus, for example, isotonic (constant force) exercises will be recommended in one case while isokinetic (resistance directly proportional to the force exerted) exercises are preferred in another.

There is a need, therefor, for a versatile exercising system with a capability to provide a wide range of operating modes so that the need for a variety of special equipment is thereby obviated.

SUMMARY OF THE INVENTION

In accordance with the invention claimed an improved hydraulic device is provided for supplying electronically controlled exercising modes.

It is, therefore, one object of this invention to provide a versatile exercising system.

Another object of this invention is to provide such a system in which any of a number of specific exercising modes is selectable by means of a switch.

A further object of this invention is to obviate the need for several different types of exercising apparatus by providing in a single versatile system a capability for producing the separate functions of such different types of equipment.

A still further object of this invention is to provide in such a system a capability for operation in a number of specific modes including:

a "normal" mode wherein resistance of a constant amount is supplied in both the lifting or "positive" stroke as well as in the lowering or "negative" stroke. This mode is similar to using weights;

a "positive only" mode wherein resistance is provided in the lifting stroke, but no force is applied in the lowering stroke;

a "negative only" mode wherein force is supplied in the lowering stroke, but no resistance is applied in the lifting stroke;

an "auto-kinetic" mode wherein the machine offers only passive resistance to restrict speed in the lifting stroke and sustains constant speed in the lowering stroke as the user resists in any degree he chooses; and a "solid" mode wherein the system maintains constant speed in both the lifting and lowering strokes.

A still further object of this invention is to provide automatically a controlled amount of force against which the user acts, the force being either constant at any desired level or variable as a function of position.

A still further object of this invention is to provide in such a system a means for automatically controlling the operation of the motor, pump, regulator, valves and other parts of the system as required to effect the various operating modes.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing in which.

DESCRIPTION OF THE PREFERRED EMBODIMENT

Figures 1, 2:
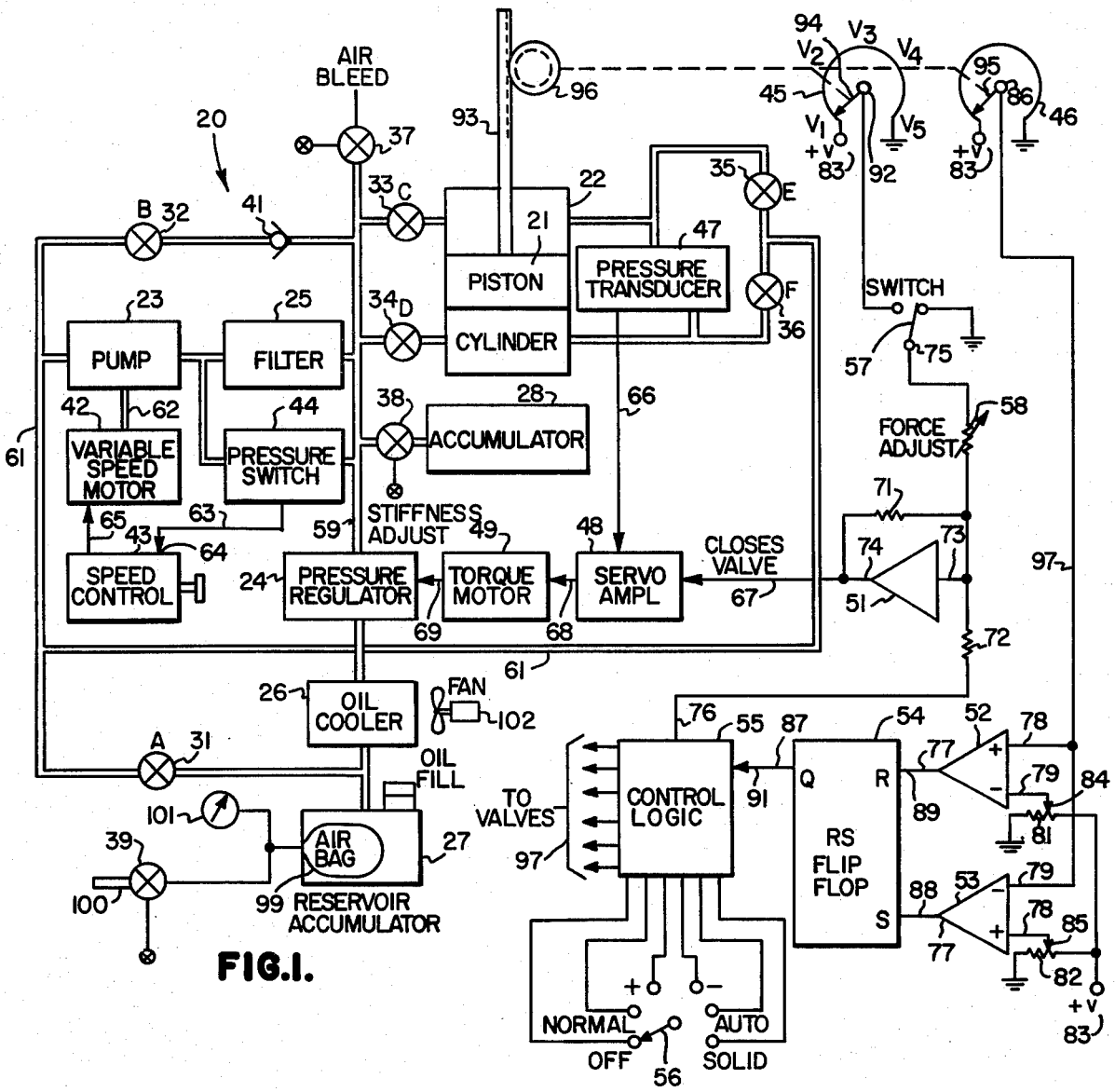
FIG. 1 is a block diagram of the versatile exercising system of the invention.
FIG. 2 is a table showing the condition of hydraulic valves A, B, C, D, E and F and of the regulator and pump utilized in the system of FIG. 1 to effect the specific operating modes 1–11 as identified in the right hand column of the table.

Referring more particularly to the drawing by characters of reference, FIG. 1 discloses the improved exercising system 20 of the invention, the system 20 comprising a piston 21 working inside a cylinder 22, and driven hydraulically by a positive displacement pump 23 operating in conjunction with a pressure regulator 24, a filter 25, an oil cooler 26, a main reservoir accumulator 27, a secondary accumulator 28, hydraulic valves 31-36 further identified by capital letters A, B, C, D, E and F, additional valves 37, 38 and 39, and check valve 41.

Driving the pump 23 is a variable-speed motor 42 under the control of a speed control 43. A pressure switch 44 monitors the pressure drop across filter 25. When the pressure drop becomes excessive, indicating a clogged filter, switch 44 operates to shut down motor 42 by intervention through control 43.

Control of the valves 31–36 and of the pressure regulator 24 is effected electronically utilizing potentiometers 45 and 46, a pressure transducer 47, a servo amplifier 48, a torque motor 49, operational amplifier 51, level comparators 52 and 53, a set/reset flip-flop 54 and a control logic network 55. A mode selector switch 56 sets up the control logic network 55 for a particular operating mode. Further modifications of the operating mode are effected by means of a switch 57 and by means of a force adjustment rheostat 58.

Interconnecting the cylinder 22 and the valves 31–39 with pump 23, regulator 24 and the other hydraulic elements of the system 20 is a network of hydraulic tubing. Formed as elements of this network are first and second main trunk lines 59 and 61. Additional sections of tubing are used to make the various interconnections between elements as follows: the upper end of cylinder 22 is connected to line 59 through valve 33 and to line 61 through valve 35; the lower end of cylinder 22 is connected to line 59 through valve 34 and to line 61 through valve 36; pressure transducer 47 has one hydraulic sense line connected to the upper end of cylinder 22 and the other hydraulic sense line connected to the lower end of cylinder 22; pump 23 and filter 25 are serially connected between lines 61 and 59 with the inlet of pump 23 connected to line 61, the outlet of pump 23 connected to the inlet of filter 25 and the outlet of filter 25 connected to line 59; pressure switch 44 has its hydraulic sensor lines connected across filter 25; pressure regulator 24, oil cooler 26 and valve 31 are serially connected between lines 59 and 61 in the order listed with one side of valve 31 connected to line 61; accumulator 28 is connected through valve 38 to line 59; and reservoir accumulator 27 is connected to the junction of oil cooler 26 and valve 31.

Motor 42 has its shaft 62 connected to pump 23. Electric contracts of pressure switch 44 are connected by electrical control lines 63 to control terminals 64 of speed control 43, and the output of control 43 is connected by electrical control lines 65 to motor 42.

Servo amplifier 48 which has input signal lines 66 and 67 connected respectively from the output terminals of transducer 47 and amplifier 51 has its output connected to torque motor 49 by lines 68. Motor 49, in turn is mechanically connected to pressure regulator 24 as indicated by line 69.

Amplifier 51, level comparators 52 and 53 and flip-flop 54 are electronic control circuits commonly employed in electronic systems.

Amplifier 51 is an operational amplifier with its voltage gain being equal to the ratio of the resistance of feedback resistor 71 to its input resistance which is equal to the combined parallel resistance of rheostat 58 and resistor 72. Feedback resistor 71 is connected between input and output terminals 73 and 74, respectively, of amplifier 51, rheostat 58 is connected between the common terminal 75 of switch 57 and input terminal 73, while resistor 72 is connected between an output terminal 76 of network 55 and input terminal 73 of amplifier 51.

Level comparators 52 and 53 are of a type commonly known as digital TTL differential comparators. Each has an output terminal 77, a "non-inverting" input terminal 78 and a "inverting" input terminal 79. If the "non-inverting" input terminal has a more positive potential than the "inverting" input terminal the output terminal will be at a positive potential; if the "inverting" input terminal is more positive than the "non-inverting" input terminal the output terminal will be negative or near ground potential.

Two potentiometers 81 and 82, their input terminals connected between ground and a positive voltage source 83 are utilized as adjustable reference elements for comparators 52 and 53, respectively, with control terminal 84 of potentiometer 81 connected to "negative" input terminal 79 of comparator 52 and with control terminal 85 of potentiometer 82 connected to input terminal 78 of comparator 53.

The "non-inverting" input terminal 78 of comparator 52 and the "inverting" input terminal 79 of comparator 53 are connected to the control terminal 86 of potentiometer 46 which has its input terminals connected between positive source 83 and ground.

Flip-flop 54 has an output terminal 87, a "set" input terminal 88 and a "reset" input terminal 89. A positive signal or pulse at the "set" input terminal causes the output terminal to be "set" to a positive level while a positive signal or pulse at the "reset" input terminal causes the output terminal to be reset to a ground or "zero" potential. Input terminal 89 is connected to output terminal 77 of comparator 52 and input terminal 88 is connected to output terminal 77 of comparator 53. The output terminal 87 of flip-flop 54 is connected to a control terminal 91 of network 55.

Rheostat 58 is connected by switch 57 to ground or to control terminal 92 of potentiometer 45 which has its input terminals connected between positive source 83 and ground.

The shaft 93 of piston 21 is coupled to the control arms 94 and 95, respectively, of potentiometers 45 and 46 by a rack 93 and pinion gear 96.

Control logic network 55 operates valves 31-36 as indicated by the arrows 97 and it exercises control over pressure regulator 24 by virtue of its connection through line 76 to amplifier 51. These functions are, in turn, controlled by the setting of mode selector switch 56 and by the status of the signal at output terminal 87 of flip-flop 54.

The operation of system 20 in its several modes is illustrated and defined by the table of FIG. 2. A description of the specific operating modes follows. Reference is made to FIG. 1 which illustrates the electrical and hydraulic systems and to FIG. 2 which indicates the status of valves A–F (31–36) as open or closed ("O" or "C" ), the status of the pump as "OFF" or "ON", and the status of regulator 24 as operative (REG), open (O) or closed (C). Where two dots are shown the status of the valve or regulator is not important, that is, it can be in either position.

Line 1 of FIG. 2 shows conditions for the "normal" operating mode as set by switch 56. As indicated, valves A, C and F are open, valves B, D and E are closed, regulator 24 is operative and pump 23 is ON.

During the lowering stroke of the "normal" mode, the hydraulic fluid from the outlet of pump 23 flows through filter 25 and through valve C into the top of cylinder 22 forcing piston 21 downward. Simultaneously, fluid below piston 21 flows out of the lower end of cylinder 22 through valve F and through line 61 to the inlet of pump 23.

In the lifting stroke the user forces piston 21 upward against the force established in cylinder 22 by pump 23. Fluid is thus forced out of the upper end of cylinder 22 through valve C. From valve C it flows downward through line 59, regulator 24, oil cooler 26, valve A, line 61 and valve F into the lower end of cylinder 22.

During both the lifting and the lowering strokes for the "normal" operating mode, the pressure across piston 21 is sensed by pressure transducer 47 through the hydraulic lines leading to the upper and lower ends of cylinder 22. In response to the pressure sensed across cylinder 22, transducer 47 delivers a signal through line 66 to servo amplifier 48. Amplifier 48 responds by delivering a signal to torque motor 49. Torque motor 49 is thereby driven to control the operation of pressure regulator 24 as appropriate to sustain a constant pressure across cylinder 22 independent of external forces applied to piston 21 through the action of the user of system 20. Thus, for example, during the lifting stroke the upward force applied to piston 21 by the user tends to increase the pressure across cylinder 22. This small increase in pressure is sensed by transducer 47, and the signal delivered to amplifier 48 is of the appropriate polarity and amplitude to provide at the output of amplifier 48 a signal which causes torque motor 49 to adjust regulator 24 in such a way as to pass more readily a flow of fluid from line 59 back to the inlet of pump 23. This control arrangement constitutes a feedback loop which tends to reduce to zero any pressure variation across cylinder 22, and the user thus experiences a constant force against which he raises piston 21 and against which he resists during the downward displacement of the lowering stroke.

In the "normal" mode there is no difference in the set condition of the valves, the regulator or the pump for the lifting or lowering strokes.

Figure 3:
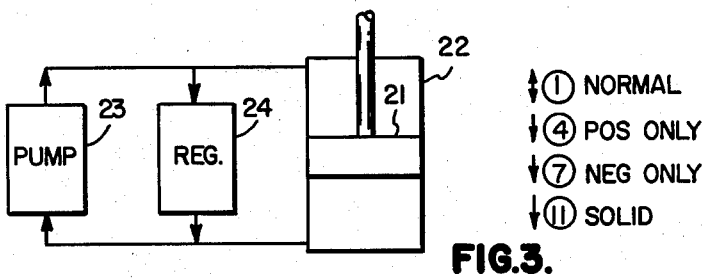
FIG. 3 is a symbolic representation of the system configuration effected for modes 1, 4, 7 and 11 of the table of FIG. 2.

A simplified representation of system 20 for the "normal" mode is shown in FIG. 3 which shows pump 23 and regulator 24 operating in parallel across cylinder 22. In FIG. 3 the arrows indicate the direction of fluid flow. During the lowering stroke most of the fluid delivered by pump 23 flows into cylinder 22 as piston 21 moves downward. During the lifting stroke all of the fluid delivered by pump 23 flows through regulator 24. In addition, as piston 21 is forced upward, the fluid flowing out of the top of cylinder 22 flows through regulator 24 and back into the lower end of cylinder 22. The specific pressure level sustained by regulator 24 is controlled by the signal delivered to amplifier 48 by amplifier 51. For a fixed and constant pressure level, switch 57 is set to ground the upper end of rheostat 58. Amplifier 51 in this condition delivers a constant signal to amplifier 48 at a level determined by the setting of rheostat 58.

If, on the other hand, switch 57 is set to connect the upper end of rheostat 58 to terminal 92 of potentiometer 45, a variable voltage is delivered to rheostat 58. Because arm 94 is mechanically coupled to piston 21 through pinion gear 96, the voltage at terminal 92 which is delivered to rheostat 58 is a function of piston position and the regulated pressure level controlled by amplifiers 51 and 48 and by motor 49, and regulator 24 is thus caused to be a function of piston position. Such variable but controlled pressure as experienced by the user in this mode of operation is desirable for certain types of physical therapy and is not readily achieved through strictly mechanical methods.

Lines 2 though 11 of FIG. 2 show valve, regulator and pump conditions for other operating modes. Lines 2, 3 and 4 show conditions for a "positive only" mode, lines 5, 6 and 7 for a "negative only" mode, lines 8 and 9 for an "auto kinetic" mode, and lines 10 and 11 for a "solid" mode. Lines 3 and 4 represent optional designs for the lowering stroke of the "positive only" mode and lines 5 and 6 represent optional designs for the lifting stroke of the "negative only" mode.

It should be noted that the various modes are set by switch 56 while condition changes between lifting and lowering strokes for a given mode are effected through the operation of flip-flop 54 as controlled by comparators 52 and 53 which, in turn are driven by potentiometer 46, potentiometer 46 being coupled to piston 21 through pinion gear 96. As piston 21 moves upward, for example, gear 96 causes arm 95 of potentiometer 46 to be rotated counterclockwise so that an increasingly positive voltage is picked up at terminal 86 and delivered by line 97 to terminal 78 of comparator 52. At the maximum upward displacement of piston 21 the voltage picked up by arm 95 and delivered to terminal 78 becomes more positive than the voltage present at terminal 79 as set by potentiometer 81. At this point, the output signal at terminal 77 of comparator 52 switches to a positive level which is delivered to reset terminal 89 of flip-flop 54. Flip-flop 54 is reset by this positive signal, its output level at terminal 87 falling to zero. This transition at the output of flip-flop 54 which is coupled to input or control terminal 91 of network 55 effects through the operation of network 55 the setting of the valve, regulator and pump conditions defined for the lowering stroke. During the lowering stroke which then follows, arm 95 of potentiometer 46 is rotated clockwise so that the voltage picked up by arm 95 becomes less and less positive. This decaying voltage level is carried by line 97 to "inverting"0 input terminal 79 of comparator 53. As the lower limit of the lowering stroke of piston 21 is reached, the voltage level at terminal 79 becomes less positive than the voltage at terminal 78 as set by potentiometer 82, and the output level of comparator 53 switches to a positive level. The positive transition at output terminal 77 which is coupled to "set" terminal 88 of flip-flop 54 causes the output of flip-flop 54 at terminal 87 to be switched to a positive level. This positive level appearing also at terminal 91 of network 55 causes the lifting stroke conditions to be set.

In summary, the operating modes are set manually by means of switch 56 while the transitions between the lifting and lowering strokes for each mode are accomplished automatically through the operation of potentiometer 46, comparators 52 and 53 and flip-flop 54. In both cases, the control network 55 sets the conditions of the valves 31–36, the regulator 24 and the pump 23.

Figure 5:
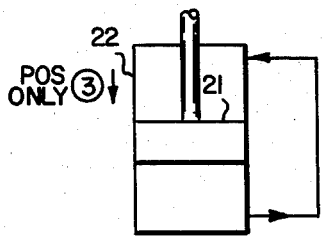
FIG. 5 is a symbolic representation of the system configuraton effected for mode 3 of FIG. 2.
Figure 4:
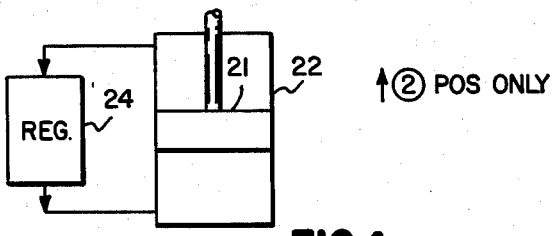
FIG. 4 is a symbolic representation of the system configuration effected for mode 2 of FIG. 2.
Figure 6:
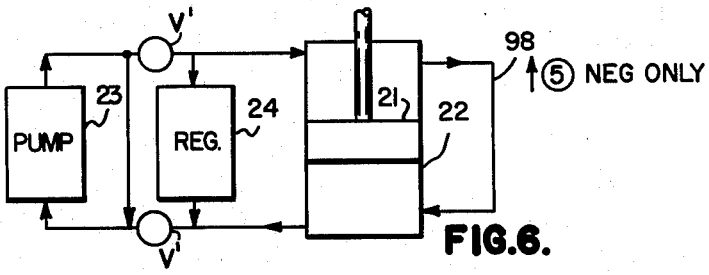
FIG. 6 is a symbolic representation of the system configuration effected for mode 5 of FIG. 2.
Figure 7:
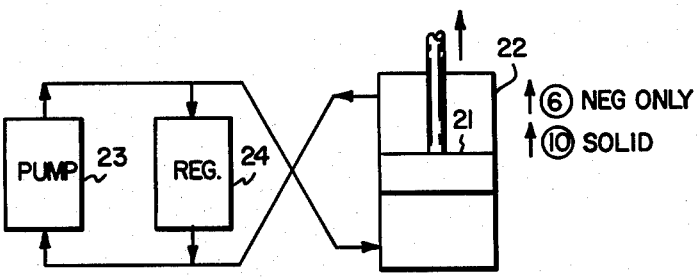
FIG. 7 is a symbolic representation of the system configuration effected for modes 6 and 10 of FIG. 2.
Figure 8:
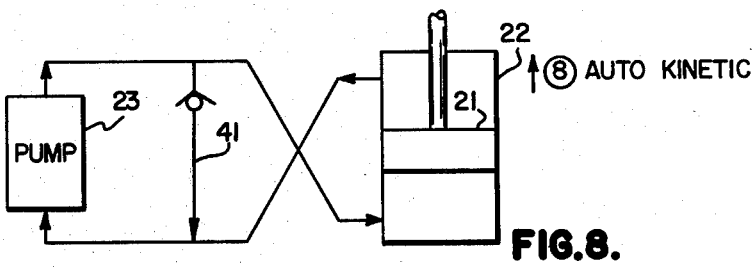
FIG. 8 is a symbolic representation of the system configuration effected for mode 8 of FIG. 2.

As in the case of the "normal" mode, simplified diagrams of FIGS. 3-9 are useful in illustrating the other modes and conditions defined by FIG. 2. In constructing these diagrams, only the major system elements, i. e. pump 23, pressure regulator 24, piston 21 and cylinder 22 are shown, and then only (except in FIG. 6) if they are operative for the mode and stroke illustrated. In FIG. 6 regulator 24 is not needed and therefor not operative with valves *v'* isolating it from cylinder 22 and pump 23. Closed valves cause the affected hydraulic lines to be eliminated and open valves are omitted with affected lines indicated as continuous. Flow direction is indicated by arrows. Because the same conditions apply in some cases to more than one mode or stroke, some of the diagrams are applicable to more than one line of FIG. 2. Thus, for example, FIG. 3 shows conditions for lines 1, 4, 7 and 11; FIG. 4 applies to line 2; FIG. 5 applies to line 3; FIG. 6 applies to line 5; FIG. 7 applies to lines 6 and 10; FIG. 8 applies to line 8; and FIG. 9 applies to line 9. The applicable lines, direction of stroke (lifting or lowering) and the operating modes illustrated are shown to the right of the diagrams.

The remaining operating modes will now be described with reference to the diagrams of FIGS. 3–9.

For the "positive only" mode in the lifting stroke FIG. 4 applies. As the piston 21 is raised, fluid flows out of the top of cylinder 22 into the top and out the bottom of regulator 24 and into the lower end of cylinder 22. Regulator 24 regulates the pressure across cylinder 22 as in the case of the normal mode, and the user thus experiences a constant resisting force as he raises piston 21.

For the "positive only" lowering stroke of line 3, FIG. 5 applies. Valves E and F (35 and 36) are both open so that a free path is provided for the flow of fluid from the lower end to the upper end of cylinder 22 as piston 21 is lowered. The user thus experiences no resistance as he lowers piston 21 other than the natural friction offered by the system.

For the alternate lowering stroke of line 4, FIG. 3 applies. While this is the same physical arrangement as for the "normal" mode, the user may practice the "positive only" mode by simply allowing the piston to move downward through the action of pump 23 so that no user force is required, even to overcome system friction.

For the "negative only" mode, i. e. the user applies force only in the downward direction, lines 5 and 6 give alternate lifting conditions and line 7 gives the lowering conditions.

The conditions of line 5 are represented by FIG. 6. In FIG. 6 pump 23 is operative but not effective because valve B is open. E and F (35 and 36) are both open and thus create a free path across cylinder 22. The advantage in leaving the pump operative is that control is simplified. Because pump 21 and regulator 24 are both utilized in the lowering stroke of line 7 it is convenient to leave them on also during the lifting stroke even though they are not needed. Under the conditions of line 5 and FIG. 6, as the piston is raised fluid flows out of the top of cylinder 22 through open valves E and F (line 98 of FIG. 6) and into the lower end of cylinder 22. Fluid from pump 23 flows through check valve 41 and valve B and back to the pump input. The force required of the user for raising the piston is limited to the weight of the piston plus force against friction both of which are minimal.

The lifting conditions of line 6 are represented by FIG. 7. In this case the user is not required to overcome piston weight or friction as the pump and regulator are operative in conjunction with valve conditions which permit the action of pump 23 to raise the piston 21. Here the fluid flows from the pump outlet into the lower end of cylinder 22 to raise piston 21. Fluid displaced from the upper end of cylinder 22 flows back to the inlet of pump 23. The user may thus remain totally passive during the lifting stroke.

The lowering stroke of line 7 is represented by FIG. 3. The user action is the same as in the "normal" mode wherein he resists the constant downward force provided by pump 23 and regulator 24 during the entire downward stroke.

In the "autokinetic" mode the machine supplies a counteractive force equal and opposite to the force applied by the user with the result that piston 21 is driven at constant speed regardless of user effort.

The conditions for the lifting stroke of the "autokinetic" mode are given by line 8 and FIG. 8. Pump 23 operates at constant speed so that a constant fluid flow from pump 23 through check valve 41 and valve B with no resulting action on the piston. When the operator raises piston 21 it can only be raised at the rate that the pump can displace the fluid from the top end of cylinder 22. Consequently, the machine supplies an amount of resistance equal to the force of the operator. If the user attempts to raise piston 21 faster than is consistent with pump speed, he will experience a reactive force equal to the force he applies because pump 23 is a gear pump which has a characteristically constant flow rate at a given speed.

Figure 9:
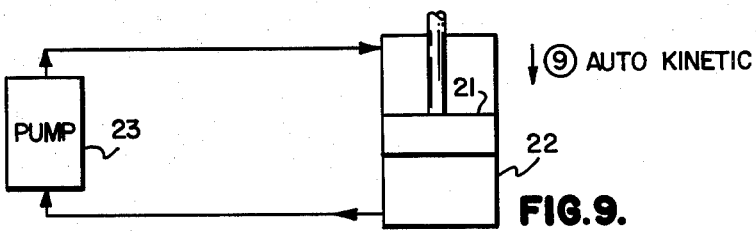
FIG. 9 is a symbolic representation of the system configuration effected for mode 9 of FIG. 2.

The same effect is provided during the "autokinetic" lowering stroke of line 9 and FIG. 9. Here again pump 23 operates at constant speed. From the outlet of pump 23, fluid flows into the top of cylinder 22 driving piston 21 downward. Displaced fluid leaves the lower end of cylinder 22 and returns to the inlet of pump 23. Force applied by the user to resist the downward motion of piston 21 result in an equal reactive force from pump 23 and an increase in electrical energy drawn by motor 42.

The "solid" mode is similar to the "autokinetic" mode lowering stroke in the sense that piston 21 is driven at essentially constant speed. The regulator is operative in this case, however, so that a maximum limit is placed on the force applied by the system. Thus, in the lifting stroke as represented by line 10 and FIG. 7, the output of pump 23 flows into the lower end of cylinder 22 to raise piston 21 at constant speed unless user force exceeds the effect of regulator 24. Similarly, during the lowering stroke of line 11 and FIG. 3, pump 23 drives piston 21 downward as pump output flows into the top of cylinder 22. Piston 21 moves downward at constant speed unless user resistance exceeds the maximum pressure permitted by regulator 24.

It will be appreciated that any of the operating modes may employ the controlled variable pressure arrangement afforded by potentiometer 45, provided regulator 24 is operative for the mode in question.

In the foregoing explanations of the operation of system 20 a number of elements were only mentioned briefly without explanations of their functions. Elements in this category include the reservoir accumulator 27, auxiliary accumulator 28, valves 37, 38 and 39, filter 25 and oil cooler 26.

Reservoir accumulator 27 holds the excess hydraulic fluid of system 20. Because the quantity of fluid held by the system is variable, a pressurized air bag 99 is contained within accumulator 27 to take up the incremental volume. Thus, for example, when piston 21 is lowered, the increasing length of the piston shaft extending into cylinder 22 displaces a small amount of fluid and bag 99 collapses as necessary to make room for the displaced fluid. The air for bag 99 is supplied from a pressurized line 100 through air charge valve 39. Air pressure is registered by gauge 101.

Valves with adjustable closure rates will be used to prevent hydraulic shock. Valve 38 provides an adjustment which controls the "stiffness" of the system by regulating the effectiveness of accumulator 28 in this function. The effect is similar to adding air to an automobile hydraulic brake system which gives the brake a spongy feel which is objectionable in brakes but desirable in some cases for exercising equipment.

Oil filter 25 is connected in series with pump 23 because all contained fluid passes eventually through pump 23. Particles of metal caused by wear and abrasion or other foreign matter introduced inadvertently into the system are thus removed from the fluid.

Heat generated by the system due to friction and the mechanical work done by the operator causes heating of the hydraulic fluid. The heat thus collected is removed by oil cooler 26 which is in the form of a radiator through which cooling air is blown by a fan 102.

Valve 37 is an air bleed valve which is employed to exhaust air from the system during charging with hydraulic fluid.

Figure 10:
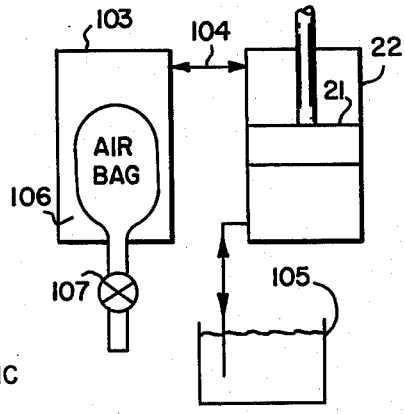
FIG. 10 is a symbolic representation of a variation of the system to FIG. 1 wherein a compressed air supply is employed to provide the force against which the user operates the piston.

An optional functional capability which may be incorporated into the system 20 is illustrated in FIG. 10. A pressurized accumulator 103 is connected by a hydraulic line 104 to the upper end of cylinder 22. The lower end is connected to reservoir accumulator 105 which may be unpressurized as indicated. An air bag 106 contained in accumulator 103 is charged to atmospheric pressure at the center of the stroke of piston 21 and valve 107 is closed. The user then works the piston 21 up and down against the pressure of the contained air within bag 103. To increase the force against which the user must act, bag 103 may be charged to higher pressures. Valve 107 is left open to admit pressurized air from a remote source at any desired regulated level. A considerable degree of controlled exercising conditions may thus be provided through the arrangement of FIG. 10 without the use of a motor or hydraulic pump so that a totally silent system is achieved.

It sould be noted that the only resistance offered during the lower half of the stroke is the stretching of the air bag. It is recommended that the pressure be kept greater than atmospheric pressure at all times.

A highly versatile exercising system is thus provided in accordance with the stated objects of the invention and although but a single embodiment of the invention relating to a hydraulic system is illustrated and described, it will be apparent to those skilled in the art that any fluid system such as a pneumatic system may also be used and other various changes and modifications may be made therein without departing from the spirit of the invention or from the scope of the appended claims.

What is claimed is:

1. An exercise apparatus selectively operable in a number of specific exercising modes comprising in combination:

a fluid actuated piston means for selectively providing in each of two opposite directions exercise resistance proportional to the setting of a control means, a control means for varying the operation of said piston means to selectively provide in each of two directions exercise resistance, said control means comprising a logic network includng a flip flop for causing said piston means to reciprocate automatically between two predetermined limits, and means for automatically and selectively proportioning in varying amounts the exercise resistance in each of said two directions.

2. The exercise apparatus set forth in claim 1 wherein:

said control means further comprises a motor actuated pump operable in conjunction with a pressue regulator and an accumulator for providing resistance to the movement of said piston means in either direction.

3. The exercise apparatus set forth in claim 2 wherein:

said control means comprises an accumulator employing an air bag inside of a fluid containing chamber, whereby said air bag is selectively inflated to a predetermined pressure to charge said accumulator for providing resistance to the movement of said piston means in either of said two directions.

4. The exercise apparatus set forth in claim 1 wherein:

said means comprises a transducer for sensing pressure on said piston means.

5. The exercise apparatus set forth in claim 4 wherein:

said means further comprises a torque motor actuated by said transducer for sustaining pressure on either side of said piston means.

* * * * *

UNITED STATES PATENT OFFICE

CERTIFICATE OF CORRECTION

Patent No. 4,063,726 Dated 12-20-77

Inventor(s) Robert J. Wilson

It is certified that error appears in the above-identified patent and that said Letters Patent are hereby corrected as shown below:

In the address on the above patent, please correct the state to read "ARIZONA" instead of Arkansas.

Signed and Sealed this

*Twenty-fifth* Day of *April 1978*

[SEAL]

*Attest:*

RUTH C. MASON
*Attesting Officer*

LUTRELLE F. PARKER
*Acting Commissioner of Patents and Trademarks*